US005775310A

United States Patent [19]

Ito et al.

[11] Patent Number: 5,775,310

[45] Date of Patent: Jul. 7, 1998

[54] IGNITION DEVICE FOR AN INTERNAL COMBUSTION ENGINE

[75] Inventors: Takahashi Ito, Hitachinaka; Katsuaki Fukatsu, Urizura-machi; Noboru Sugiura, Mito, all of Japan

[73] Assignees: Hitachi, Ltd.; Hitachi Car Engineering Co., Ltd., both of Japan

[21] Appl. No.: 773,087

[22] Filed: Dec. 24, 1996

[51] Int. Cl.[6] ..... F02P 3/04

[52] U.S. Cl. ..... 123/644; 123/630; 123/651

[58] Field of Search ..... 123/630, 644, 123/651, 652; 315/209 T

[56] References Cited

U.S. PATENT DOCUMENTS

| | | | |
|---|---|---|---|
| 4,993,396 | 2/1991 | Miura | 123/651 |
| 5,045,964 | 9/1991 | Bennett et al. | 123/644 X |
| 5,571,245 | 11/1996 | Ooyabu et al. | 123/644 X |
| 5,609,145 | 3/1997 | Kojima et al. | 123/652 X |
| 5,623,912 | 4/1997 | Kelly | 123/644 |

OTHER PUBLICATIONS

"Patent Abstracts of Japan", vol. 14, No. 375 (M1010), Abstract of Jp–02–136563, Aug. 1990.

*Primary Examiner*—Tony M. Argenbright

*Attorney, Agent, or Firm*—Evenson, McKeown, Edwards & Lenahan, P.L.L.C.

[57] ABSTRACT

An igniter for an internal combustion engine includes a switching element performing flow and break control for a primary current flowing through an ignition coil depending upon a spark control signal output from an electronic engine control unit and a current limiting circuit limiting a current flowing through the switching element. The switching element is formed with an insulated gate bipolar transistor. The igniter further comprises a current detecting load element for detecting current flowing through the insulated gate bipolar transistor, and a diode being provided between the current detecting load element and the self-isolation N-MOS transistor, which diode having an opposite temperature coefficient to that of the current detecting load element. Also, in order to certainly provide a contact current of a connection terminal between the electronic engine control unit and the igniter and to assure detecting of circuit breakage between the electronic engine control unit and the igniter, an input impedance of the igniter is set intentionally or a current adjusting bleeder resistor is set to flow a current greater than or equal to 1 mA through the connecting portion.

10 Claims, 9 Drawing Sheets

IGNITION DEVICE FOR AN INTERNAL COMBUSTION ENGINE

BACKGROUND OF THE INVENTION

The present invention relates generally to an ignition device or igniter for an internal combustion engine. More specifically, the invention relates to an igniter for an internal combustion engine, in which a switching element effecting current flow and break control for a primary current flowing through an ignition coil on the basis of an spark control signal output from an electronic engine control unit (hereinafter referred to as "ECU"), and whereby generating a high voltage at secondary side., is constructed with an insulated gate bipolar transistor (hereinafter referred to as "IGBT")

A conventional igniter, is disclosed in Japanese Unexamined Patent Publication (Kokai) No. Heisei 2-136563. The disclosed system includes a current limitation circuit constructed with a bipolar transistor amplifier circuit or a bipolar junction transistor differential amplifier circuit. Also, a current detecting portion detects only potential difference caused by a resistor element.

In the prior art set forth above, since the current limitation circuit is constructed with the bipolar transistor amplifier circuit or the bipolar junction transistor differential amplifier circuit, it becomes necessary to provide isolation or bipolar junction structure for integrating with an IGBT. This encounters a drawback in increasing of element area and number of required masks to make fabrication process complicated. Also, since the current detecting portion detects only potential difference caused by the resistor element, no consideration has been given for influence of a temperature for a detection level.

On the other hand, the above-identified prior art keeps silent about a problem potentially caused on reliability of connection due to excessively small contact current at an input terminal portion as the IGBT is driven by voltage. Namely, in an igniter directly driving the IGST by the spark control signal from ECU, since the IGBT is a voltage driven type switching element constructed with insulated gate type element, little current is required for the spark control signal from the ECU. Also, in the case where the current limitation circuit is provided, little current is required unless current restriction is active. Therefore, only quite little current in the order of μA may flow through a connection terminal portion between the ECU and the ignition system. In such case, it is essential to assure contact reliability between the terminals. However, the prior art has not given any consideration to this point.

Furthermore, the above-identified prior art keeps silent for possibility of providing functions, such as breakage detection and so forth, as a spark ignition system combined with the ECU. Namely, the ECU normally performs detection of circuit breakage between the ECU and the igniter, at an output portion thereof. However, when the foregoing igniter is employed, since there is little difference in current upon occurrence and absence of circuit breakage for only little current flowing from the ECU to the igniter, detection of circuit breakage by the ECU becomes impossible. The foregoing prior art gives no consideration for this point.

SUMMARY OF THE INVENTION

Therefore, it is an object of the present invention to provide an igniter for an internal combustion engine which has a compact structure which does not make the fabrication process complicated for increasing of area of elements and number of masks upon integration of a current restricting circuit together with an IGBT into single chip.

Another object of the present invention is to provide an igniter for an internal combustion engine which has a current restricting function with lesser temperature dependency.

A further object of the present invention is to provide a spark ignition device for an internal combustion engine which certainly provides reliability in connection between the igniter employing the IGBT and an ECU.

A still further object of the present invention is to provide an igniter for an internal combustion engine which can detect circuit breakage at an output portion of the ECU.

In order to accomplish the above-mentioned object, a current limiting circuit is constructed with a self-isolation N-MOS transistor circuit, and is formed within an IGBT chip. A protection circuit for protecting the IGBT is integrated with the IGBT together with other circuit of the current limiting circuit.

On the other hand, the present invention feature in elimination of influence of a temperature of a current detecting circuit by providing a diode in a current limiting circuit portion.

Also, an input impedance of the igniter is set to have a current flowing from ECU to the igniter to be greater than or equal to 1 mA for certainly providing a contact current of a connection terminal portion. By this, a Sn plated terminal can be used in place of Au plated terminal which has been conventionally employed for preventing oxidation and assuring reliability of connection.

Also, by providing a circuit impedance to flow the current greater than or equal to 1 mA from the ECU to the igniter, a voltage variation at the output stage of ECU upon occurrence of circuit breakage becomes sufficiently large to enable to use a circuit breakage detecting means which is normally employed in the ECU, can be employed in combination with the igniter employing the IGBT.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENTS

The present invention will be discussed hereinafter in detail in terms of the preferred embodiments of the invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to prevent unnecessarily obscuring the present invention.

Figure 1:
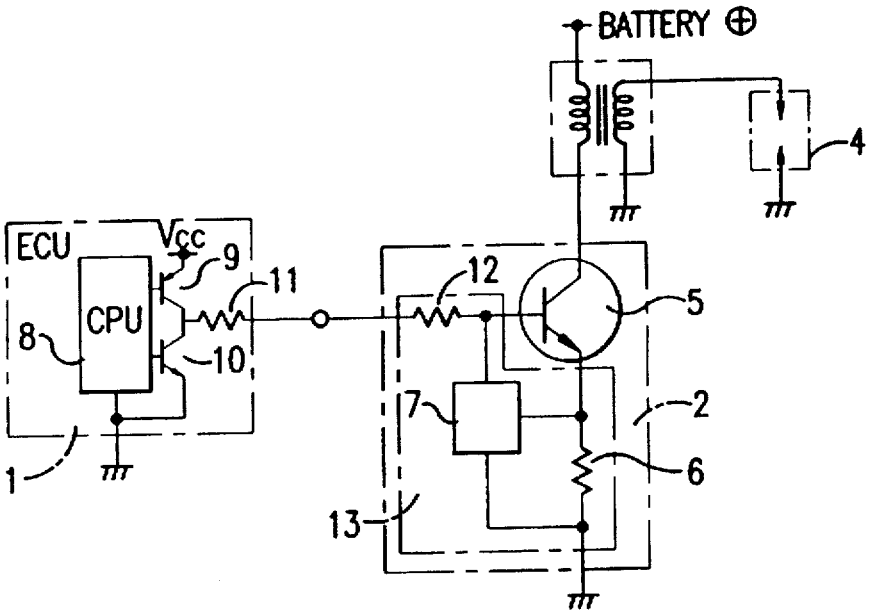
FIG. 1 is circuit diagram showing a basic construction of a spark ignition system, for which the present invention is applied.

At first, FIG. 1 shows a general construction of a typical spark ignition system, for which the present invention is applicable. The reference numeral 1 denotes an ECU, 2 denotes an igniter, 3 denotes a spark ignition coil and 4 denotes a spark ignition plug. An output stage of the ECU 1 is constructed with a PNP transistor 9, an NPN transistor 10 and a resistor 11 so that the transistors 9 and 10 are turned ON and OFF at appropriate timing derived by a CPU for outputting HIGH and LOW pulse to an igniter. The igniter 2 is constructed with a power transistor 5, a current detecting load mounted on a hybrid IC 13, a current limiting circuit 7 and an input resistor 12. The power transistor 5 is responsive to variation of the output signal of the ECU 1 from LOW level to HIGH level to initiate current flow and from HIGH level to LOW level to break current to generate a high voltage in a range of 300 to 400 V at a collector portion thereof.

Figure 2:
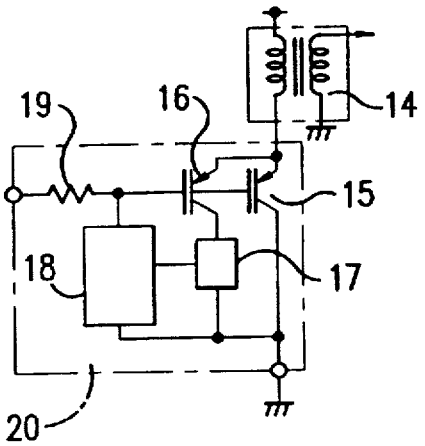
FIG. 2 is a circuit diagram showing an internal equivalent circuit of the igniter, in which one embodiment of an IGBT according to the present invention and a protection circuit are integrated into single chip.

FIG. 2 shows an internal equivalent circuit showing a construction of one embodiment of the igniter, in which one embodiment of an IGBT according to the invention and a protection circuit are integrated into a single chip. The reference numeral 14 denotes an ignition coil, 15 denotes a main IGBT forming a main circuit for flowing and breaking a primary current flowing through a primary coil of the ignition coil, 16 denotes a current detection sub IGST for detecting the primary current. Also, the reference numeral 17 denotes a current detecting circuit for detecting the primary current, 18 denotes a current limiting circuit for controlling a gate voltage and whereby for limiting the primary current at a set value, 19 denotes an input resistor. The reference numeral 20 denotes an IC, in which the main IGBT 15, the sub IGBT, the current detecting circuit 17 and the current limiting circuit 18 are integrated into a single chip. The shown embodiment as illustrated in FIG. 2 is differentiated from typical system in that the power transistor, the current detecting load, the current control circuit are constructed with an integrated circuit on a common single chip.

Figure 3:
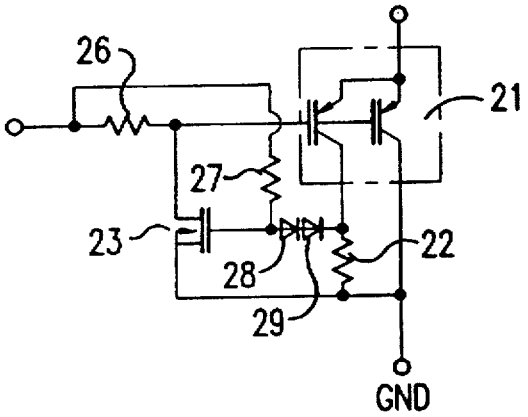
FIG. 3 is a circuit diagram showing detail of a circuit of the igniter, in which one embodiment of an IGET according to the present invention and a protection circuit are integrated into single chip, according to the invention.

FIG. 3 shows a detailed construction of one embodiment of a spark ignition system according to the present invention.

Figure 8:
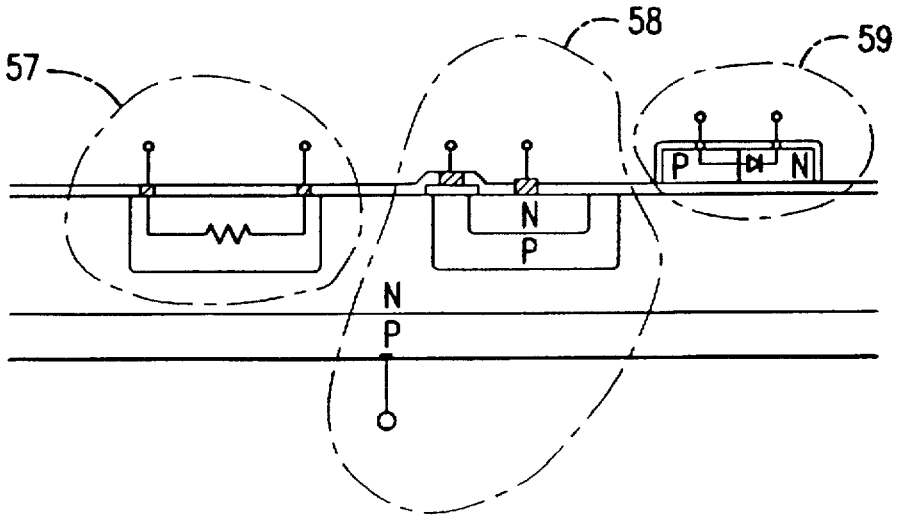
FIG. 8 is a cross-sectional view of an integrated chip, in which a diffused resistor and polycrystalline silicon diode is integrated with one embodiment of an IGBT according to the present invention, according to the invention.

At an input stage of the igniter, an input resistor 26 is provided. A power transistor 21 is the IGBT, in which an enhancement-type n-channel MOS gate transistor and a PNP bipolar transistor are combined, and is constructed with the main IGBT forming a main circuit and the current detecting sub IGBT for detecting the primary current. The main IGBT and the sub IGBT are shared at current ratio in a range of 1000:1 to 10000:1. A current detecting load element 22 is provided between an emitter of the sub IGBT and GND, which current detecting load element 22 is formed with a diffusion resistor in the single chip. For example, when the current ratio is 1000:1, if 8 A of current flows through the main IGBT, 8 mA of current flows through the sub IGBT. Assuming a detecting voltage is 0.8 V, since 0.8 (V)/0.008 (A)=100 Ω, a resistance of the diffusion resistor is set at 100 Ω. Under the same condition, if the current ratio between the main IGBT and the sub IGBT is 10000:1, the resistance of the diffusion resistor is set at 1 kΩ. The current ratio and the resistance value may be set arbitrarily. An example of a diffusion resistor 57 formed in an IGBT 58 is shown in FIG. 8.

A input stage of the current limiting circuit is applied a bias voltage by a forward voltage of diodes 28 and 28 pulled up by a resistor 27. By setting a temperature coefficient of the forward voltage of the diodes so that a temperature characteristics on the basis of a gate threshold voltage of a N-MOS transistor 23 and a temperature coefficient of the current detecting load element 22 can be canceled, a relationship between a current and a detection voltage becomes constant to enable current detection having no temperature coefficient.

For instance, the diffusion resistor generally has a positive temperature coefficient of 2000 to 3000 ppm. Therefore, assuming that the temperature coefficient of the resistor is 2500 ppm and a detection level is 0.8 ±0.2 V (0.6 to 1.0 V), if 100° C. of a temperature elevation is caused in the current detection circuit, the resistance value is varied for 25%. Then, the detection voltage corresponding to the current becomes 1.0 V to rise +0.2 V. In contrast to this, since the diode generally has −2 mV/°C. of negative temperature coefficient, upon 100° C. of temperature elevation, =2 mV×100° C.−0.2 V of voltage variation is caused. Thus, temperature coefficient of the resistor can be canceled. In the shown embodiment, the diodes 28 and 29 are connected in series with also taking the temperature coefficient of the threshold voltage of the N-MOS transistor. These diodes are formed with polycrystalline silicon. An example of polycrystalline silicon diode 59 formed on the IGBT 58 is shown in FIG. 8.

Figure 4:
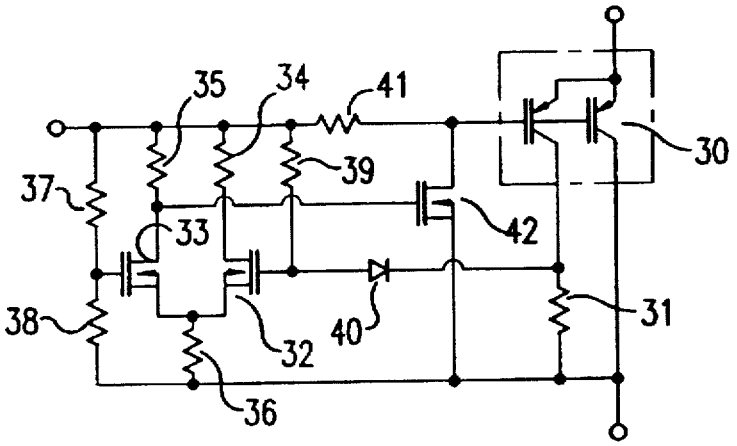
FIG. 4 is a circuit diagram showing detail of a circuit of the igniter, in which another embodiment of an IGBT according to the present invention and a protection circuit are integrated into single chip, according to the invention.

FIG. 4 shows another embodiment. Similarly to the former embodiment, a power transistor 30 is constituted of the main IGBT forming a main circuit and the current detecting cub IGBT for detecting the primary current. A current detecting load element 31 is provided between the sub IGBT and the GND. The current detecting load element is constructed with a diffusion resistor in the single chip.

A current control circuit portion has a differential amplifier circuit construction constituted with N-MOS transistors 32 and 33, resistors 34, 35 and 36. The N-MOS transistors in the shown embodiment are self-isolation type, similarly to the former embodiment and thus are built-in PNPN semiconductor structure forming the IGBT. A differential reference voltage is set by resistors 37 and 38. An input stage of the current control circuit is applied a bias voltage by a forward voltage of diode 40 pulled up by a resistor 39. The reference numeral 42 denotes a N-MOS transistor to be an output stage of a differential amplifier circuit. By setting a temperature coefficient of the forward voltage of the diode 40 so that a temperature characteristics on the basis of temperature coefficients of a reference voltage of the differential amplifier circuit and the current detecting load element 31 can be canceled, a voltage drop by the load element 31 becomes constant to permit current detection with no temperature coefficient. The principle of the operation is as discussed with respect to the former embodiment. However, in the shown embodiment, since the current limiting circuit is constructed with the differential amplifier circuit and thus the temperature coefficient of the threshold voltage of the N-MOS transistor does not influence for current detection, the temperature characteristics can be canceled with single diode 40.

Figure 5:
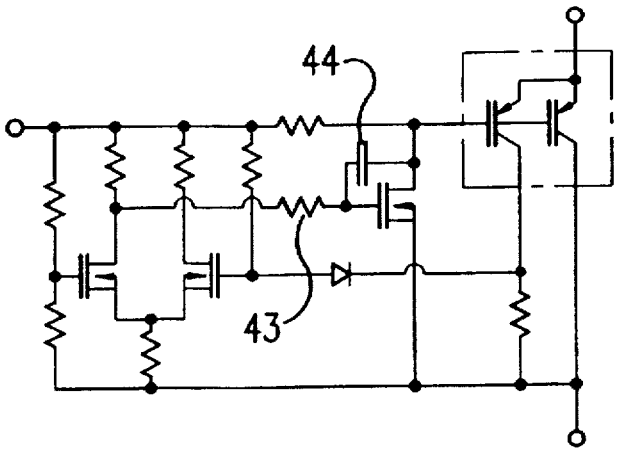
FIG. 5 is a circuit diagram showing detail of a circuit of the igniter, in which a further embodiment of an IGBT according to the present invention and a protection circuit are integrated into single chip and a Miller integrator circuit is provided in a current limitation circuit, according to the invention.
Figure 9A:
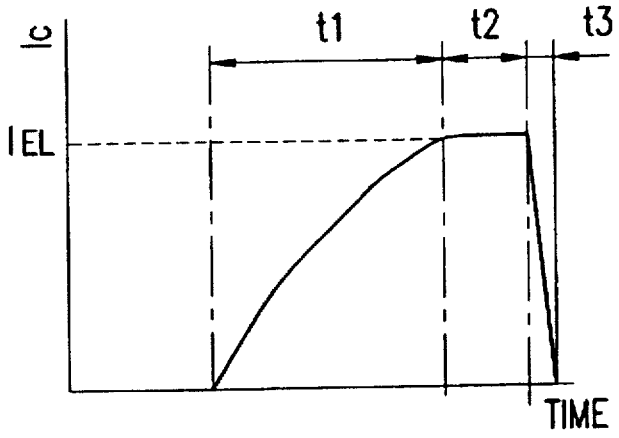
FIGS. 9A and 9B are charts showing waveforms for explaining current restriction.
Figure 9B:
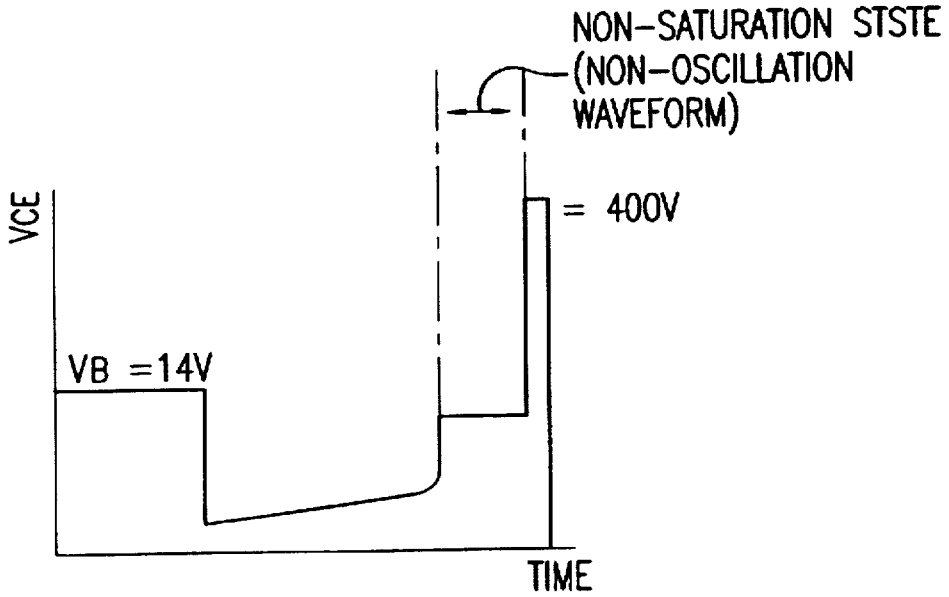
Figure 10:
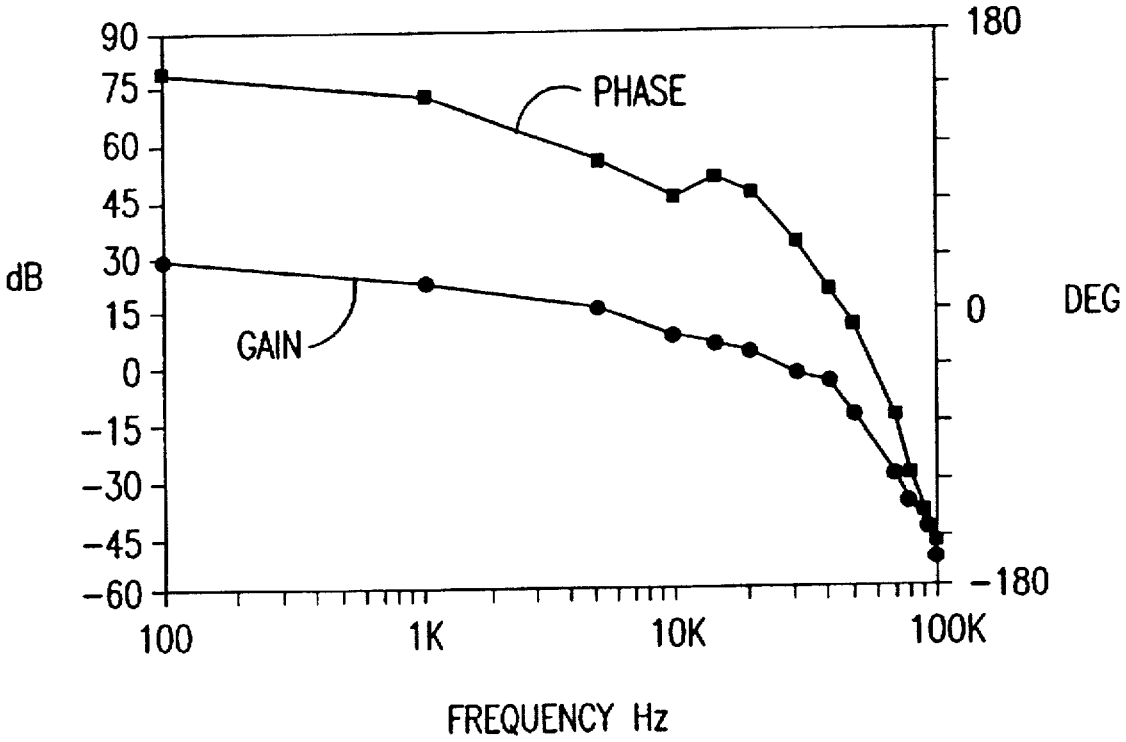
FIG. 10 is a chart showing a loop frequency response characteristics.

FIG. 5 shows an embodiment, in which a Miller integrator circuit is provided in the IGBT igniter. It should be noted that like elements to those of FIG. 4 are identified by like reference numerals. The conventional bipolar transistor has a construction for restricting oscillation phenomenon upon non-saturation state by lowering a loop transmission gain by providing the Miller integrator circuit, after current detection. In the shown embodiment, the Miller integrator circuit is constructed with a current limiting circuit constructed with a MOS differential amplifier, a resistor 43 and a capacitor 44. However, in a MOS transistor amplifier circuit and a MOS differential amplifier circuit in the IGBT, the construction shown in FIG. 4 is preferred for integration into a single chip, since it becomes possible to eliminate oscillation phenomenon in non-saturated state with giving importance for providing a phase margin of a loop gain of the loop transmission by constructing an amplifier circuit with low gain. One example of waveforms showing operation of the IGBT are illustrated in FIGS. 9A and 9B. When a spark signal is input to the IGBT, the IGBT is turned On and collector current flows, a collector-emitter voltage of the IGBT rises (t1). At a timing where the collector current reaches a current limiting value, the IGBT becomes a non-saturated state and the current is controlled to be constant ($I_{EL}$) (t2). When the IGBT is turned OFF, the current is shut off (t3). $V_E$ is 14 V of a battery voltage. The current control at the timing t2 may cause oscillation of current at a timing where non-saturation control is effected in relation to a secondary delay due to a primary inductance of the ignition coil and amplification ratio or the IGBT. Therefore, it is important to perform loop frequency response analysis of a feedback loop to conform sufficient gain margin. As a condition to cause oscillation, there is a case where a gain is greater than or equal to 0 dB and phase is delayed for 180°. FIG. 10 shows one example of loop transmission phase-gain frequency response under the condition where one end of the feedback loop is opened. In the shown example, oscillation is not caused. On the other hand, when the N-MOS current limiting circuit is constructed by the Miller integrator circuit, delay becomes large to make margin against oscillation small. Therefore, for integration into a single chip, the construction shown in FIG. 4 is advantageous.

Figure 6:
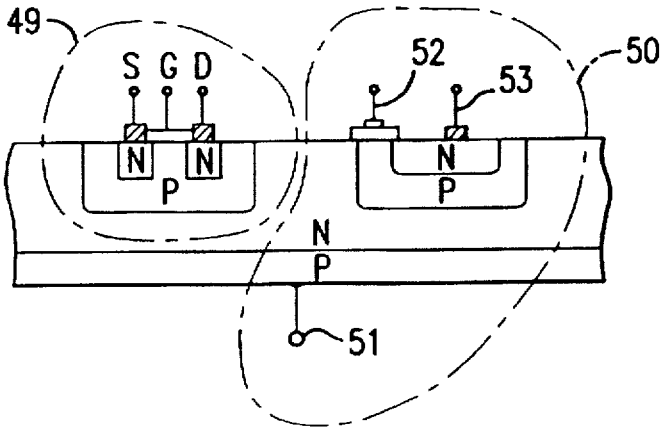
FIG. 6 is a cross-sectional view of one embodiment of an integrated chip, in which one embodiment of an IGBT according to the present invention and a self-isolation type N-MOS transistor, according to the invention.

FIG. 6 shows a construction, in which a current control circuit portion is built-in the IGBT. Since the current control circuit portion is constructed with the self-isolation type N-MOS transistor, it becomes possible to build-in the transistor in the PNPN semiconductor structure forming the IGBT. An IGBT 50 is constructed with four layer structure of PNPN of semiconductor. By connecting a positive voltage of a power source to a collector 51 and a negative voltage of the power source to an emitter 52, a N channel is formed in a void layer by applying a sufficient positive voltage to a gate 53 insulated by an oxide layer. Thus, current flows from the collector to the emitter. The self-isolation type N-MOS transistor 49 has a construction, in which N layer is formed in a P base layer of the IGBT, a source and a drain are drawn therefrom, and a gate terminal insulated by the oxide layer is provided therebetween. AS the N-MOS transistor, both of enhancement type and depletion type may be applied.

Figure 7:
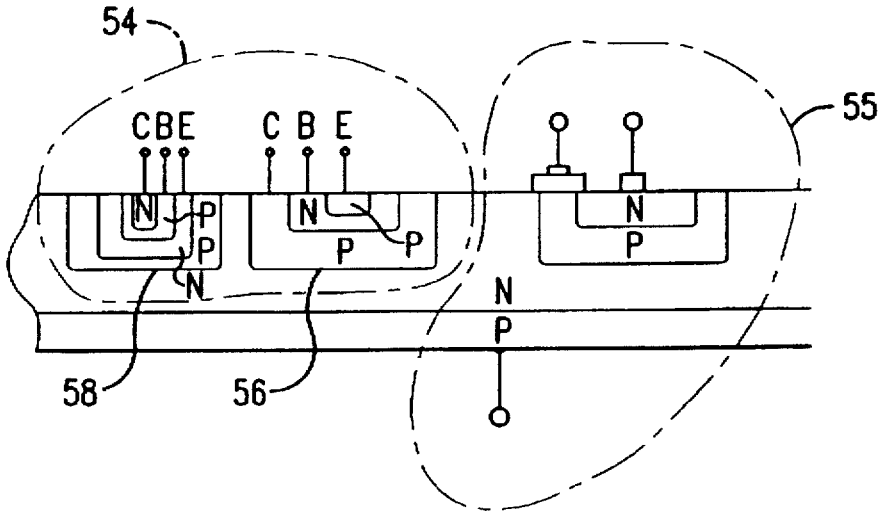
FIG. 7 is a cross-sectional view of an integrated chip, in which the IGBT and a junction-isolation type transistor are integrated into single chip.

FIG. 7 shows the case where the transistor is constructed with a junction isolation type transistor and integrated in the TGBT as single chip. For forming a junction isolation type transistor 54, a P-substrate 56 is provided. PNP or NPN transistor is formed in the P-substrate 56. This structure is far different from the basic structure of the IGBT 55 to cause not only increasing of number of masks but also increasing the number of layers in the P-N structure to be greater than or equal to four to cause various problems in fabrication and function.

In the embodiment of the present invention set forth above, the current limiting circuit taking temperature compensation into account can be easily formed in the IGBT chip, integration into single chip cab be facilitated to make it possible to produce highly reliable single chip igniter.

Figure 11:
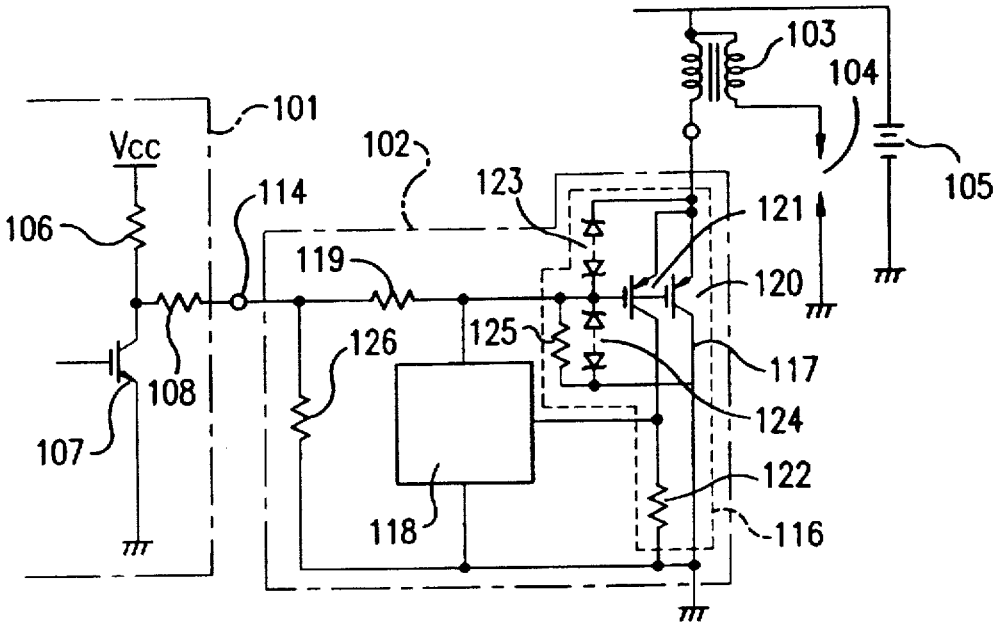
FIG. 11 is a circuit diagram showing another embodiment of the spark ignition system according to the invention.

FIG. 11 shows another embodiment of the present invention. In the shown embodiment, similarly to the former embodiment, a current limiting circuit is integrated with the IGBT into a single chip. In the shown spark ignition system, the reference numeral 101 denotes an ECU, 102 denotes an igniter, 102 denotes a ignition coil, 104 denotes a spark plug and 105 denotes a battery. An output stage of the ECU 101 is connected to a collector terminal of a NPN transistor 107 and a resistor via a resistor 106 from a reference power source Vcc formed in the ECU 101, and to the igniter 102 via the resistor 108. The transistor 107 is turned ON and OFF at an appropriate spark ignition timing to generate HIGH and LOW spark signal on the collector portion thereof for driving the igniter 102. A single chip igniter 116 is constructed with an IGBT 117, a current limiting circuit 118, an input resistor 119. The IGET 117 is constituted of a main IGBT 120 and a sub IGBT 121. A current ratio of the main IGBT 120 and the sub IGBT 121 is shared in a ratio in the former embodiment set forth above. A current detecting load 122 is provided between an emitter of the sub IGBT 121 and the GND. Also, between a gate and a collector of the IGBT 117, a bidirectional Zener diode 123 is formed with polycrystalline silicon. Between the gate and the emitter of the IGBT, a protecting bidirectional Zener diode 124 and a resistor 125 are formed. A resistor 126 provided between an input of the igniter 102 and the GND is a terminal current controlling bleeder resistor according to the present invention. In response to transition of output signal of the ECU 101 from LOW level to HIGH level, the IGBT 117 starts conduction of current and from LOW level to HIGH level, the IGBT 117 breaks flow of the current to induce a high voltage of approximately 400° C. at the collector portion of the IGBT 117.

In general, the igniter employing the IGBT directly controls a gate voltage of the IGBT 117 by the output signal from the ECU 101. Since a large current flows between the collector and emitter by voltage control as feature of the IGBT, little current flows on the gate of the IGBT, namely a connecting terminal 114 of the ECU 101 and the igniter 102. On the other hand, even in the current limiting circuit, in normal operation where current limitation is not effective, little current is consumed. Therefore, only little current in the order to μA flows through the connection terminal 114 to make reliability of connection between the terminals unstable. For the connection terminal, normally Sn plating is applied. When a contact current between the terminals is small as set forth above, oxidation is caused on the terminal to potentially cause connection failure. Therefore, when the contact current between the terminals is small, plating for the connection terminals is performed by expensive Au plating for preventing the terminal from causing oxidation to assure reliability. In the present invention, an input impedance of the igniter 102 (an impedance as viewed from a spark signal input portion from the ECU 101) is intentionally set to provide higher than or equal to 1 mA of terminal current flowing to the connection terminal 114 to provide sufficiently high reliability of connection even with Sn plating as plating for the connection terminal 114. The input impedance (bleeder resistance) is set by a resistor 126 provided between the a current adjusting input terminal and the GND. It is also possible to certainly provide a terminal current greater than or equal to 1 mA by setting impedance of a circuit construction of the igniter without employing the bleeder resistor. In either case, values of Vcc of the ECU 101, the resistor 106 and the resistor 107 are set to be greater than or equal to 1 mA in total. The bleeder resistor may be formed as a diffusion resistor in the PNPN semiconductor structure forming the IGBT similarly to the diffusion resistor shown in FIG. 8 or by a polycrystalline silicon 59 shown in FIG. 8.

Figure 12:
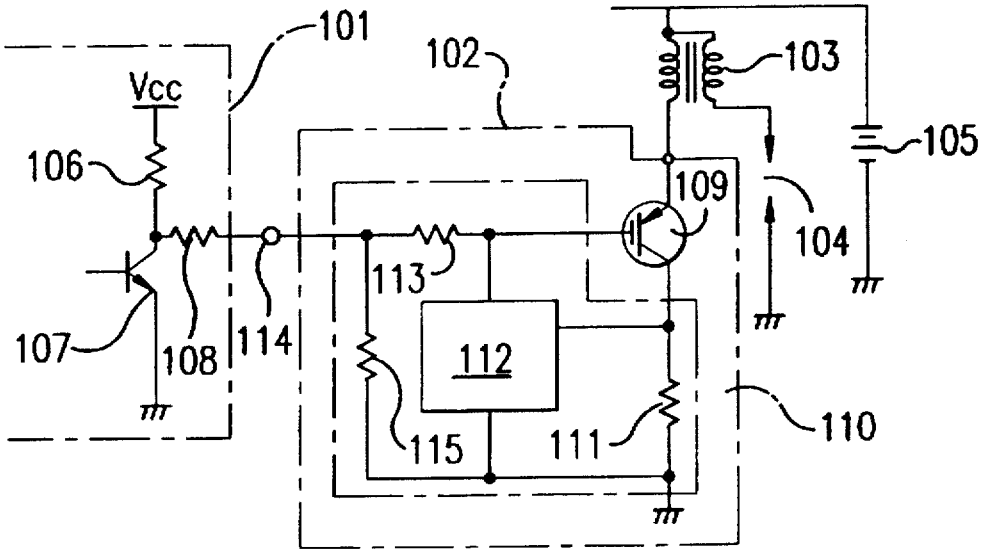
FIG. 12 is a circuit diagram showing a further embodiment of the spark ignition system according to the invention.

FIG. 12 shows a further embodiment of the present invention. In viewpoint of assuring connecting ability between the ECU 101 and the igniter 102, in addition to the case where the current limiting circuit is integrated with the IGBT to form the single chip igniter, it the invention is applicable for the igniter constructed with an IGBT 109, a current detecting load 111 mounted on a hybrid IC 110, a current limiting circuit 112 and an input resistor 113. By a resistor 115 (bleeder resistor) provided between the input terminal of the igniter and the GND, an input impedance is set to provide the terminal current greater than or equal to 1 mA. On the other hand, the operation of the shown embodiment is basically the same as the former embodiment.

Figure 13:
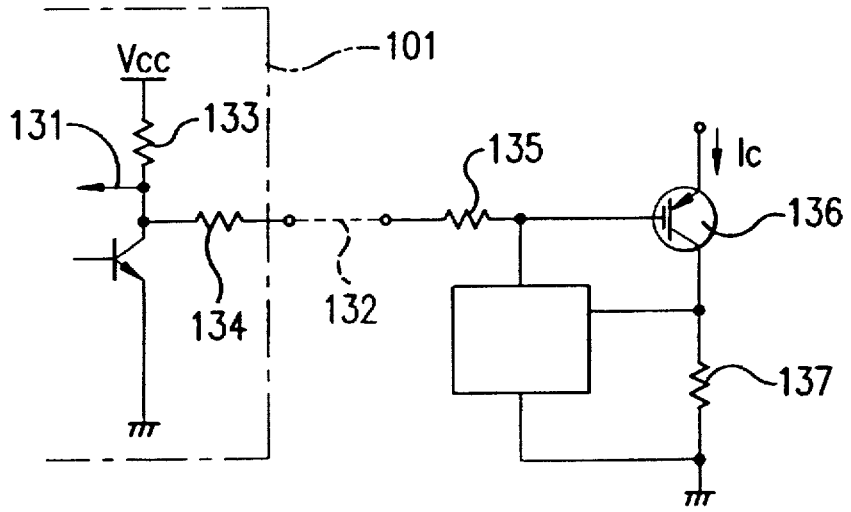
FIG. 13 is a circuit diagram showing a construction for detecting circuit breakage in the ECU.
Figure 14:
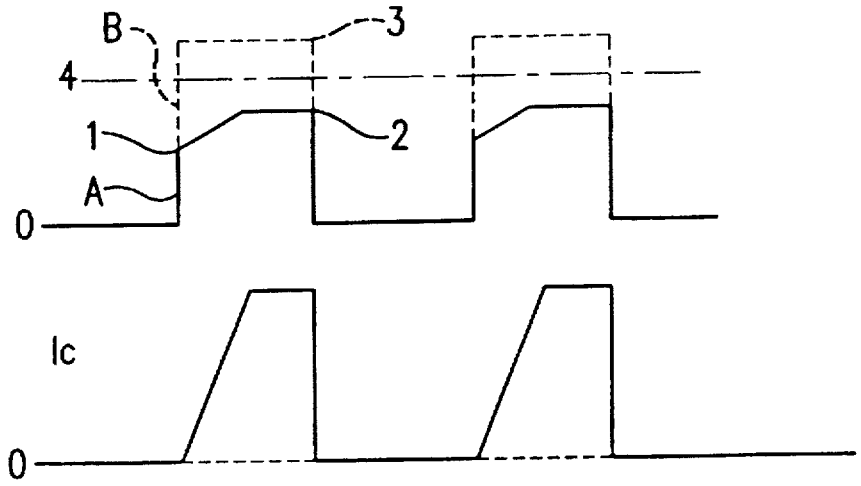
FIG. 14 is a chart showing operation waveforms upon detection of circuit breakage (in the case where bipolar transistor is employed)
Figure 15:
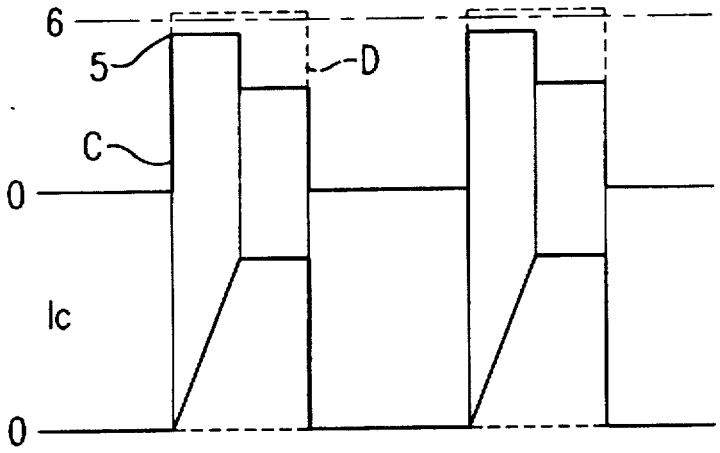
FIG. 15 is a chart showing an operation waveform upon detection of circuit breakage (in normal IGBT igniter)
Figure 16:
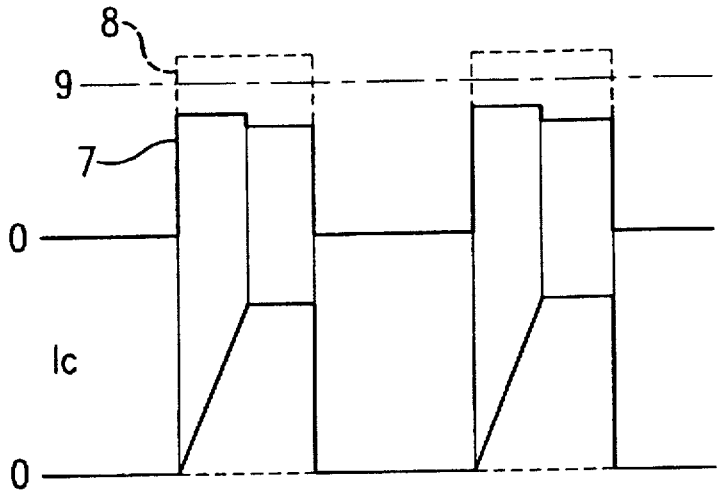
FIG. 16 is a chart showing an operation waveform upon detection of circuit breakage (in the IGBT spark ignition system of the present invention).

Next, discussion will be given with respect to detection of circuit breakage in a connecting portion between the ECU in the spark ignition system and the igniter employing the bipolar transistor, with reference to FIGS. 13 and 14. When a connecting portion 132 becomes open due to circuit breakage or other reason, a signal generated by a breakage detecting portion 131, which is as shown by solid line A in FIG. 14, in the normal state, is turned into a signal as shown by broken line B at occurrence of circuit breakage. Further detailed discussion will be given for this point. Upon outputting of HIGH signal under normal state, the HIGH signal is input from the Vcc of the ECU 101 to the igniter via the resistors 133 and 134. Then, a current flows from the resistor 135 and the base of a bipolar transistor 136 a current flows to the GND via the emitter and the current detecting load 137. By this, a voltage of ① of A of FIG. 14 becomes [Vcc−($V_{BE}$ of bipolar transistor 136)×[(resistor 134+resistor 135)+(resistor 133+resistor 134+resistor 135)]+Io ×resistor 137. ② shows the fact that Ic becomes constant as the current restriction becomes effective. On the other hand, when circuit breakage is caused at the connecting portion 132, the signal is as shown by broken line B. ③ shows a value of Vcc. At this time, a reference voltage of ④ is set to make judgment that circuit breakage is caused when the reference voltage is exceeded. However, the igniter employing typical IGET, a signal shown in FIG. 15 is output from the circuit breakage detecting portion. C shows the signal in the normal operating state, and D shown by broken line represents the occurrence of circuit breakage. As can be seen from FIG. 15, since the IGBT requires little current, the voltage at ⑤ where the current limitation is not active, has little difference from the voltage upon occurrence of the circuit breakage. Therefore, setting of the reference voltage ⑥ for detection of circuit breakage becomes quite difficult and thus detection of circuit breakage becomes impossible. In contrast to this, in the present invention, as shown in FIG. 16, since the voltage can be controlled by the impedance of the igniter or the bleeder resister as shown by ⑦, substantial difference of the voltage to the voltage ⑧ upon occurrence of circuit breakage can be provided. Therefore, the reference voltage ⑨ can be set similarly to the conventional circuit breakage detecting method in the igniter not provided with the IGBT. Thus, circuit breakage can be detected successfully.

As set forth above, in the preferred embodiments of the present invention, in the igniter employing the IGBT, connection current can be certainly obtained. Satisfactorily high reliability can be certainly achieved even when inexpensive Sn plating is used for the connection terminal. Also, circuit breakage in connection between the ECU and the igniter can be certainly detected.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. An igniter for an internal combustion engine comprising:

a switching element performing flow and break control for a primary current flowing through an ignition coil depending upon a spark control signal output from an electronic engine control unit; and a current limiting circuit limiting a current flowing through said switching element;

said switching element being constructed with an insulated gate bipolar transistor;

said current limiting circuit being constructed with self-isolation N-MOS transistor; and said insulated gate bipolar transistor and said self-isolation N-MOS transistor being formed in a common semiconductor substrate.

2. An igniter as set forth in claim 1, which further comprises a current detecting load element for detecting current flowing through said insulated gate bipolar transistor, and a diode being provided between said current detecting load element and said self-isolation N-MOS transistor, which diode having an opposite temperature coefficient to that of said current detecting load element.

3. An igniter as set forth in claim 1, wherein said current limiting circuit is a differential amplifier circuit constructed with the self-isolation N-MOS transistor.

4. An igniter as set forth in claim 1, wherein said igniter is provided an input impedance so that a connection terminal current between said igniter and said electronic engine control unit becomes larger than or equal to 1 mA.

5. An igniter as set forth in claim 1, wherein a connection terminal between said igniter and said electronic engine control unit is provided a Sn plating.

6. An igniter as set forth in claim 4, wherein said impedance of said igniter is set by a connection terminal current adjusting resistor provided between an input terminal of said igniter for said spark control signal and GND.

7. An igniter as set forth in claim 4, wherein said connection terminal current adjusting resistor is formed in said semiconductor substrate by a diffusion resistor or polycrystalline silicon.

8. An igniter for an internal combustion engine comprising:

a switching element performing flow and break control for a primary current flowing through an ignition coil depending upon a spark control signal output from an electronic engine control unit, said switching element being formed with an insulated gate bipolar transistor; and said igniter being provided an input impedance so that a connection terminal current between said igniter and said electronic engine control unit becomes larger than or equal to 1 mA .

9. An igniter as set forth in claim 8, wherein said impedance of said igniter is set by a connection terminal current adjusting resistor provided between an input terminal of said igniter for said spark control signal and GND.

10. An igniter as set forth in claim 9, wherein a control circuit for said igniter is constructed with a hybrid IC, said connection terminal current adjusting resistor is a resistor sintered or mounted on said hybrid IC.

* * * * *